United States Patent [19]

de Valroger et al.

[11] 3,999,369

[45] Dec. 28, 1976

[54] ELECTROMECHANICAL WATCH MOVEMENT

[76] Inventors: Pierre Albert Marie de Valroger, 15, rue de Presles, 75015 Paris, France; Marius Lavet, 36, rue Gabrielle, 75018 Paris, France

[22] Filed: Apr. 15, 1975

[21] Appl. No.: 568,286

[30] Foreign Application Priority Data

Apr. 18, 1974 France ..... 74.13489

[52] U.S. Cl. ..... 58/23 D; 58/28 R; 58/116 R; 310/36

[51] Int. Cl.[2] ..... G04C 3/00

[58] Field of Search ..... 310/25, 36–38, 310/46, 48, 49 R, 49 A, 15, 162–164; 58/23 R, 23 TF, 23 V, 23 BA, 28 R, 28 A, 28 B, 28 D, 116 R, 116 M, 23 D

[56] References Cited

UNITED STATES PATENTS

| | | | |
|---|---|---|---|
| 3,196,603 | 7/1965 | Reich | 310/36 X |
| 3,238,399 | 3/1966 | Croymans et al. | 310/49 A |
| 3,435,311 | 3/1969 | Matsuzawa et al. | 58/28 R X |
| 3,506,897 | 4/1970 | Clifford | 310/25 X |
| 3,541,778 | 11/1970 | Ingenito et al. | 58/23 R |
| 3,587,223 | 6/1971 | Zatsky | 58/23 BA |
| 3,604,201 | 9/1971 | Dome | 58/116 X |
| 3,737,746 | 6/1973 | Cielaszyk et al. | 310/37 X |
| 3,816,779 | 6/1974 | Lundin | 58/116 M X |
| 3,844,104 | 10/1974 | Schlicht | 58/28 B |

*Primary Examiner*—Ulysses Weldon
*Attorney, Agent, or Firm*—Robert E. Burns; Emmanuel J. Lobato; Bruce L. Adams

[57] ABSTRACT

A low-cost electromechanical watch movement comprises a step-by-step motor including a multipolar rotor mounted for rotation within an encased stator and carrying driving pallets operatively engaging with a time-display gear train. The stator and rotor each have a like number of alternate pole pieces disposed on arcuate surfaces concentric to the axis of the rotor and separated radially by arcuate air-gaps of constant section. Small circumferential air-gaps separate the pole-pieces of the stator and, possibly, the rotor. The pole pieces of the rotor are permanently magnetized and those of the stator electromagnetically energizable by a winding supplied with periodic electric pulses from a pulse generator to drive the rotor through an angle less than 15° in response to a pulse. A spring lightly biases the rotor to its initial position. In the absence of a current pulse, the total permeance of the air gaps produced by the permanent magnetization remains substantially constant whereby during return of the rotor by the biasing spring no retaining torque is produced by magnetic attraction.

8 Claims, 19 Drawing Figures

FIG. 1
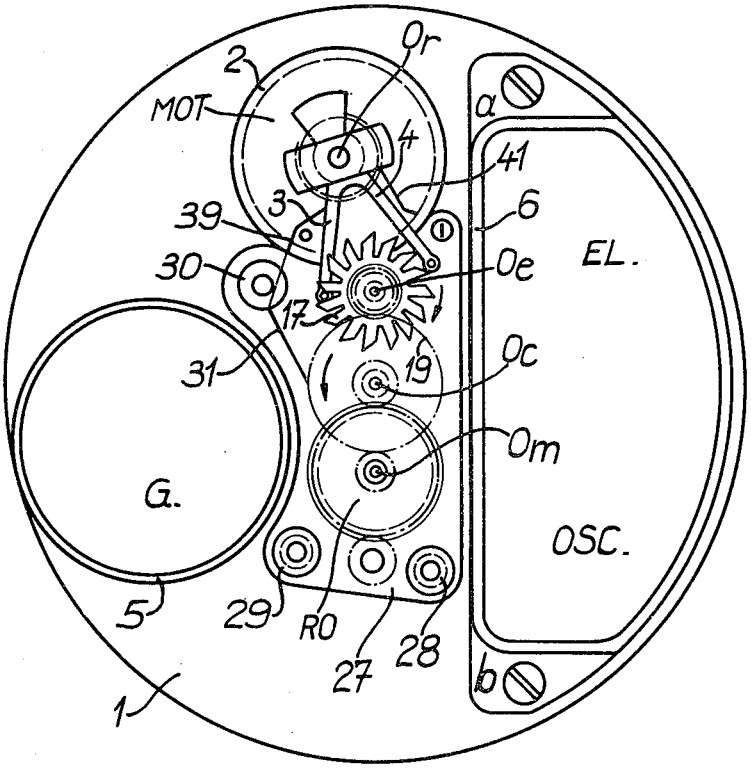
FIG. 2a
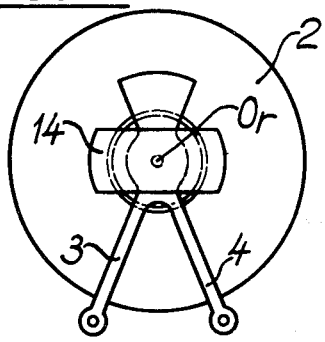
FIG. 3
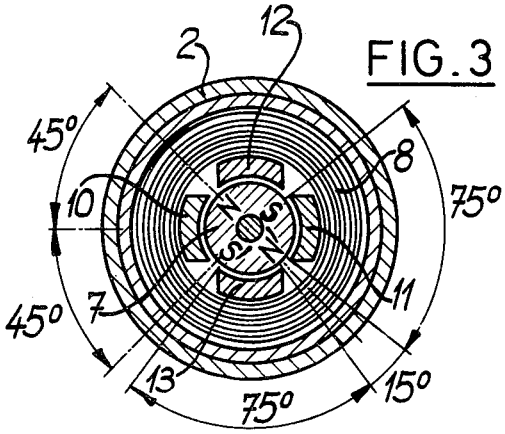
FIG. 2b
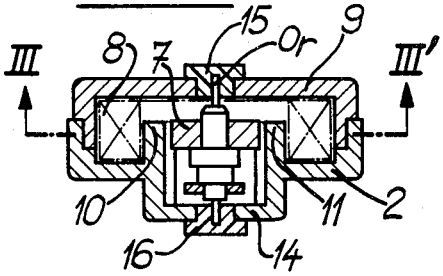
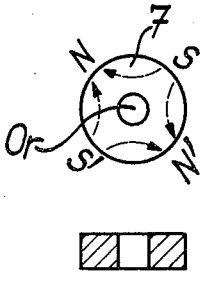
FIG. 4

VI
7°
7°
MOT
2
15
7
14
Or
41
39
3
f2
4
40
f1
4'
17
3'
18
30
Oe
19
31
Oc
20
RO
33
Om
27
21
28,37
29
VI 9
2
1
8
12
14
16
Or
15
7
13
4
17
8
4'
9
Oe
23
18
26
1
20
32
Oc
RO
19
36
Om
35
33
34
21
22
27
38
37
28

FIG. 12
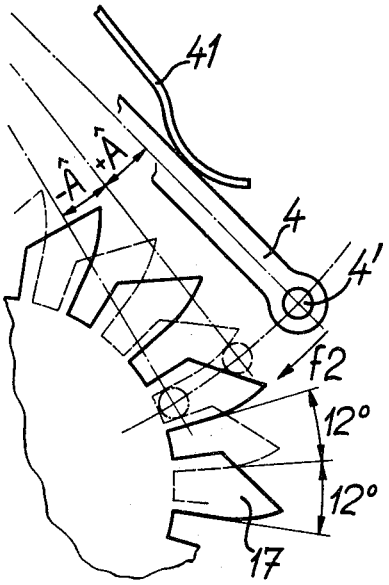
FIG. 13
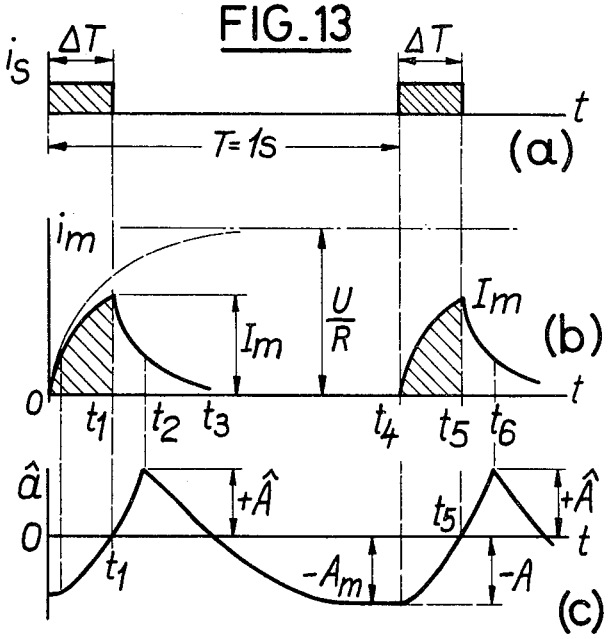
FIG. 14
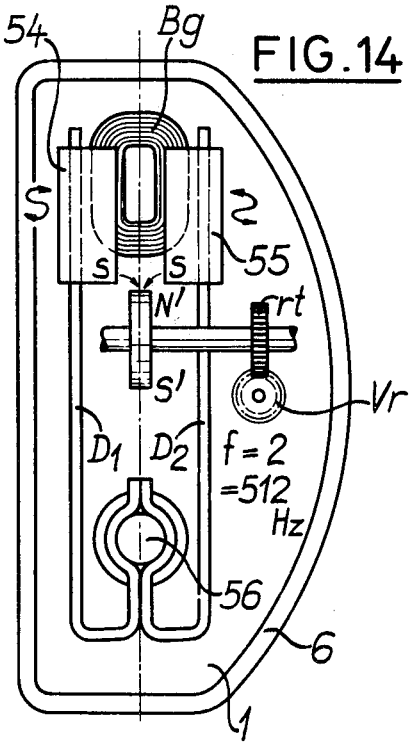
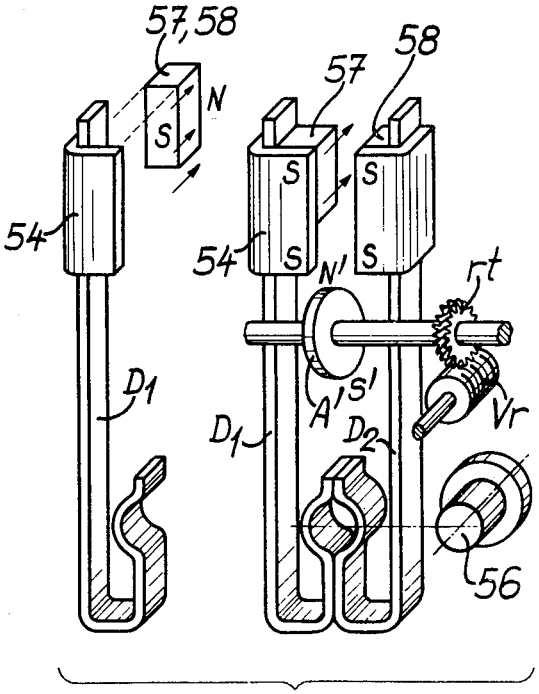
FIG. 15

FIG. 16
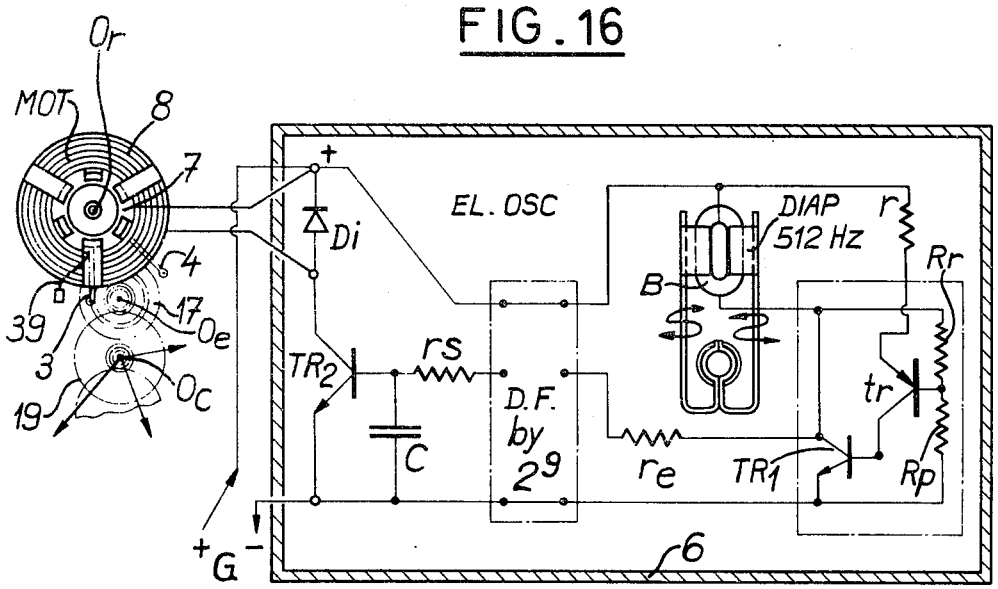
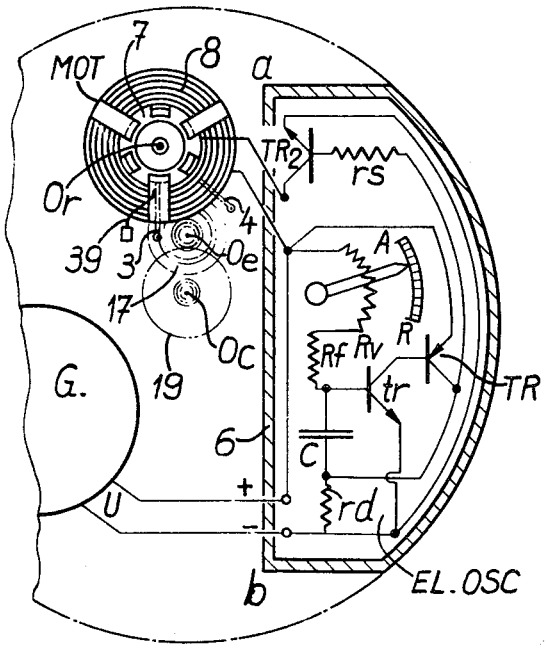
FIG. 17
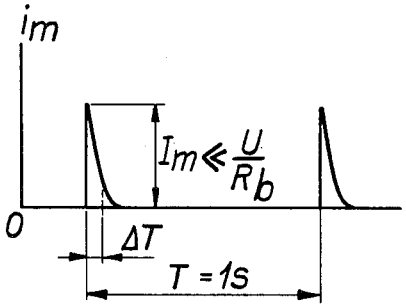
FIG. 18

ELECTROMECHANICAL WATCH MOVEMENT

The invention concerns electromechanical watches of the type comprising a pulse generator supplying a step-by-step motor which drives the hands or equivalent time indicating means.

An object of the invention is to provide a novel and original movement for a watch of this type of which the electrical and mechanical components can be mass produced at low cost and are arranged to have a very low energy consumption, as well as an ease of assembly by automatic methods.

A watch movement according to the invention comprises a step-by-step motor including a multipolar rotor mounted for rotation within a stator. Driving pallets are connected to the rotor for oscillation therewith, said driving pallets operatively engaging with a time-display gear train. A case of high magnetic permeability material is disposed about and magnetically shields the stator. The stator and rotor each have a like number of alternate pole pieces disposed on arcuate surfaces concentric to the axis of the rotor whereby opposite pole pieces of the stator and rotor are separated radially by arcuate air-gaps of constant section. The pole pieces of the rotor are permanently magnetized and the pole pieces of the stator are electromagnetically energizable by a winding disposed within said case. A pulse generator supplies periodic electric pulses to said winding to energize the pole pieces of the stator and thereby drive the rotor from a first angular position to a second angular position through an angle less than 15° in response to a pulse. A spring or similar means lightly biases the rotor from said second position towards said first position. Small circumferential air-gaps separate the pole-pieces of the stator. The extent of said arcuate surfaces of the pole pieces being such that the total permeance of the air gaps produced by the permanent magnetization remains substantially constant during rotation of the rotor from its second to its first position under the action of said biasing means whereby no retaining torque is produced by magnetic attraction.

Embodiments of the invention will now be described in detail, and by way of example, with reference to the accompanying drawings, in which:

FIG. 1 is an enlarged-scale rear plan view of a watch movement according to the invention;

FIGS. 2*a* and 2*b* are a plan view and a diametral section of a motor of FIG. 1;

FIG. 3 is a cross-section along line III–III′ of FIG. 2*b;*

FIG. 4 shows a detail of the motor of FIGS. 2*a*, 2*b* and 3;

Figure 7:
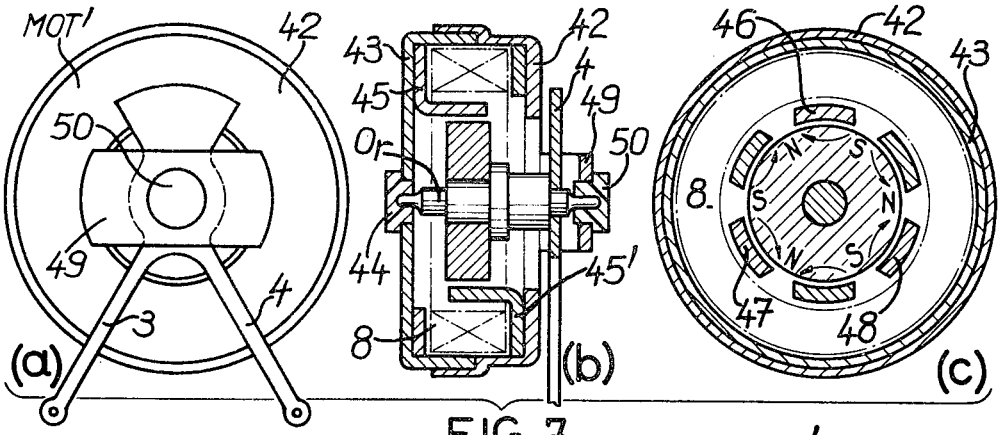
Figure 8:
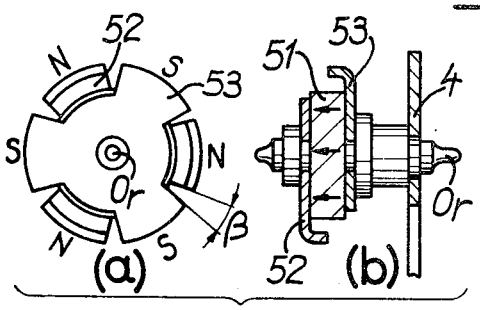
Figure 9:
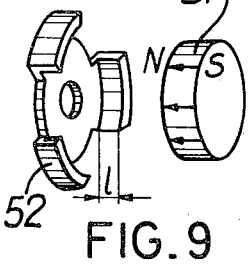
Figure 10:
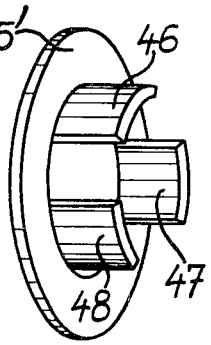
Figure 11:
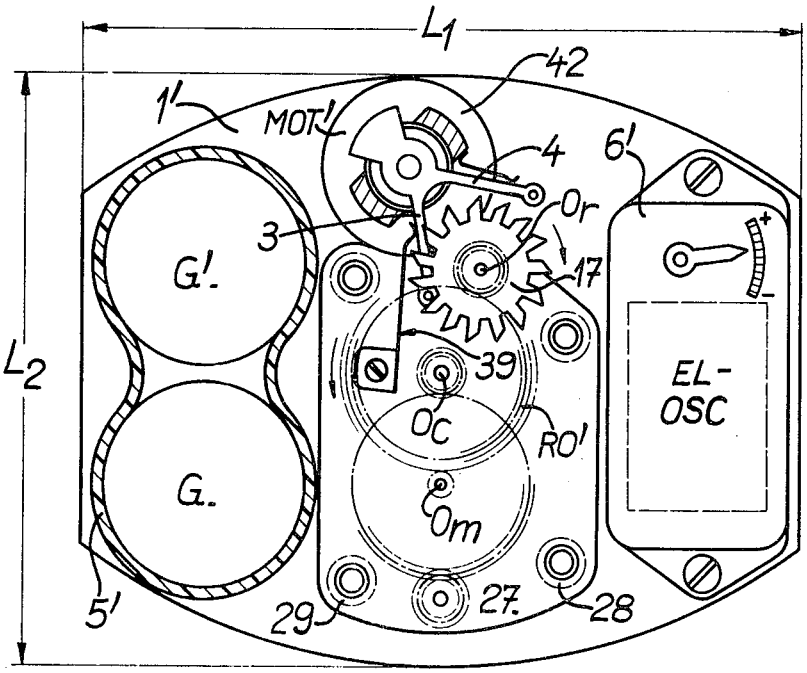

FIGS. 7*a*, *b* and *c* are respectively a plan view, and axial and transverse cross-sections of a different embodiment of the;

FIGS. 8*a* and *b* are respectively a plan and a side-elevation, partly in section, of the rotor of the motor of FIG. 7;

FIG. 9 is an exploded perspective view of part of FIG. 8;

FIG. 10 is a perspective view of part of the stator of the motor shown in FIG. 7;

FIG. 11 is an overall plan view of another embodiment of a movement;

FIG. 12 is an enlarged schematic view illustrating operation of a driving part;

FIG. 13 shows waveforms which illustrate the mode of operation;

FIGS. 14 and 15 show a first type of time base;

FIG. 16 schematically shows the arrangement of a maintenance circuit for the time base of FIG. 14;

FIG. 17 shows a pulse generator formed by an electric oscillator circuit; and

FIG. 18 is a graph showing current pulses produced by the circuits of FIGS. 16 or 17.

FIG. 1 shows the overall layout of an economically manufactured battery-supplied watch movement, shown on an enlarged scale (approx 5:1), and composed basically of four parts:

1. a miniature step-by-step motor MOT including a magnetoelectric rotor having a small amplitude oscillating movement, enclosed within a round casing 2 of soft iron or tempered alloy having a very high magnetic permeability, the rotor carrying driving pallets on pallet arms 3 and 4 of a yoke;

2. a gear train RO comprising, mounted on a removable plate, a pallet or escapement wheel, pinions and toothed wheels driving hours, minutes and seconds hands (not shown) about a central axis of a shaft $O_c$ and pipe system;

3. a hermetically closed round case 5 enclosing a standard, removable cell G able to drive the watch for a year; and 4. a protective case 6 enclosing a pulse generator device EL - OSC, connected to cell G, to deliver short periodic pulses to the winding of motor MOT and hence drive gear-train RO step-by-step.

Pulse generator device EL - OSC takes up an appreciable part of the space available in the watch case. The casing 6 has the general shape of a circular segment defined by a chord *ab* spaced from the central axis (of shaft $O_c$) by approximately a quarter the inner diameter of the case. Casing 6, for example of iron-nickel mumetal coated with copper or another good electrically conducting material, forms a screen to remove the influence of external magnetic and electric fields.

Motor MOT may be provided in several manners. A preferred embodiment shown in FIGS. 2 to 6 comprises a small pivotally mounted permanent magnet 7 forming a light rotor, surrounded by a single round winding 8 concentric to the rotor axis $O_r$. Winding 8 is manufactured separately on an automatic machine, and forms a removable toric unit. The stator is encased in two cups 2 and 9 of soft ferromagnetic material, interengaging with a tight frictional fit whereby they can be separated in case the motor must be dismantled.

Spaced slightly apart from the periphery of magnet 7 are four pole pieces each having the form of a portion of a tube concentric to axis $O_r$. The angular extent of each arcuate pole piece is slightly less than 90°, for example about 75° leaving an angular spacing of 15° between adjacent pole pieces. Two diametrally opposed pole pieces 10 and 11 of the stator are integral with the bottom cup 2 whereas the other two pole pieces 12 and 13 are integral with top cup 9 (see FIG. 6). The toric winding 8 surrounds pole pieces 10, 12, 11 and 13 and, when the winding receives a short d.c. pulse, the pairs of pole pieces 10 and 11 and 12 and 13 are temporarily magnetized with opposite polarity.

Rotor 7 is a tetrapolar (N, S, N′, S′9 permanent magnet, for example a ring of highly-coercive isotropic barium ferrite of approximately 3mm diameter, magnetized to saturation by a special machine to form four alternating peripheral poles at 90°, the internal lines of force having the shape and direction indicated by the arrows on FIG. 4. This known type of multipolar magnetization is possible even for the mentioned small diameter of the magnet. It is also possible to use a composite magnet formed of a highly coercive central part with an axial bipolar magnetization, surrounded by two cheeks of steel with imbricated polar teeth staggered by 90° to form four alternating peripheral poles; this arrangement, which enables the number of rotor poles to be increased, will be described later with reference to FIGS. 7 to 9.

The rotor magnet 7 is cemented on a machined shaft $O_r$ having pivots freely turning in low-cost self-lubricating plastic material bearings. Experience has shown that reduction of the weight of the rotor and balancing of the lateral magnetic attractions enble the use of relatively robust or substantial pivots having a cross-section about four times as great as that of the pivots of a watch balance.

Figure 6:
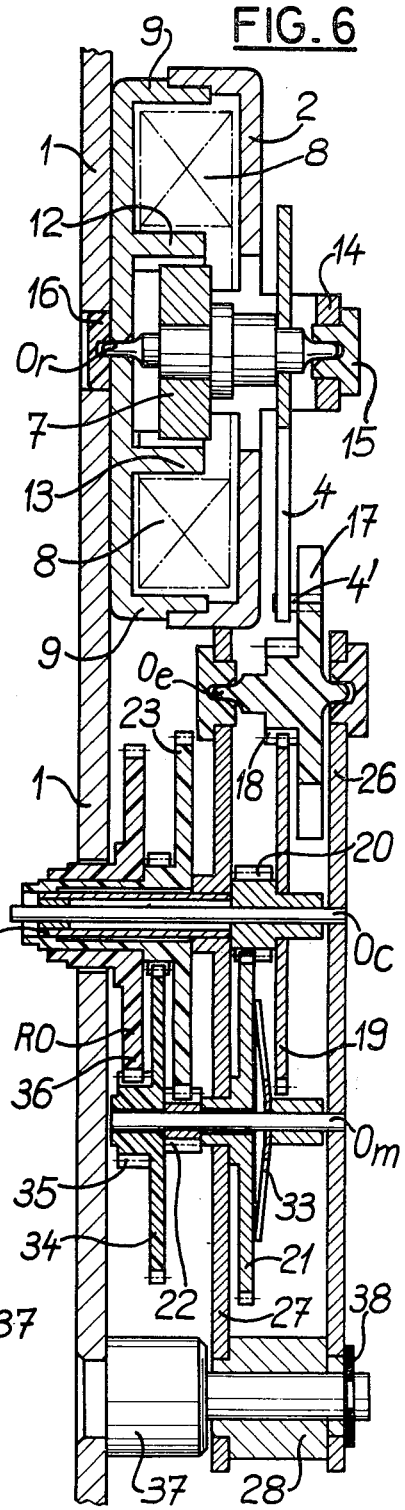
FIG. 6 is a cross-section along line VI—VI of FIG. 5.

To reduce frictional losses in the pivots, it has been found advantageous to place the shaft $O_r$ between two bearings disposed as shown in FIG. 6. To this end, the bottom of stator cup 2 is bored to a diameter slightly greater than that of the rotor and is extended, on either side of the bore, by a narrow bridge 14. This bridge 14 is located facing and spaced apart from magnet 7 by a distance sufficient to allow passage of the pallet arms 3 and 4.

Bearings 15 and 16 of plastic material having blind bores are provided to absorb longitudinal movements of the pivot when it is subjected to a shock. Longitudinal play of the shaft $O_r$ is thus reduced, and sliding takes place solely at the ends of the pivots which are of very small diameter, approx. 0.1 mm. This arrangement gives better results than the usual construction of step-by-step motors consisting of fixing a removable central pinion on a pivot extending through its bearing. The driving yoke carrying the pallet arms is fixed firmly on the shaft $O_r$, as shown in FIG. 6. To dismantle the rotor, it suffices to remove cup 2, this operation enabling the replacement of winding 8 if necessary.

Figure 5:
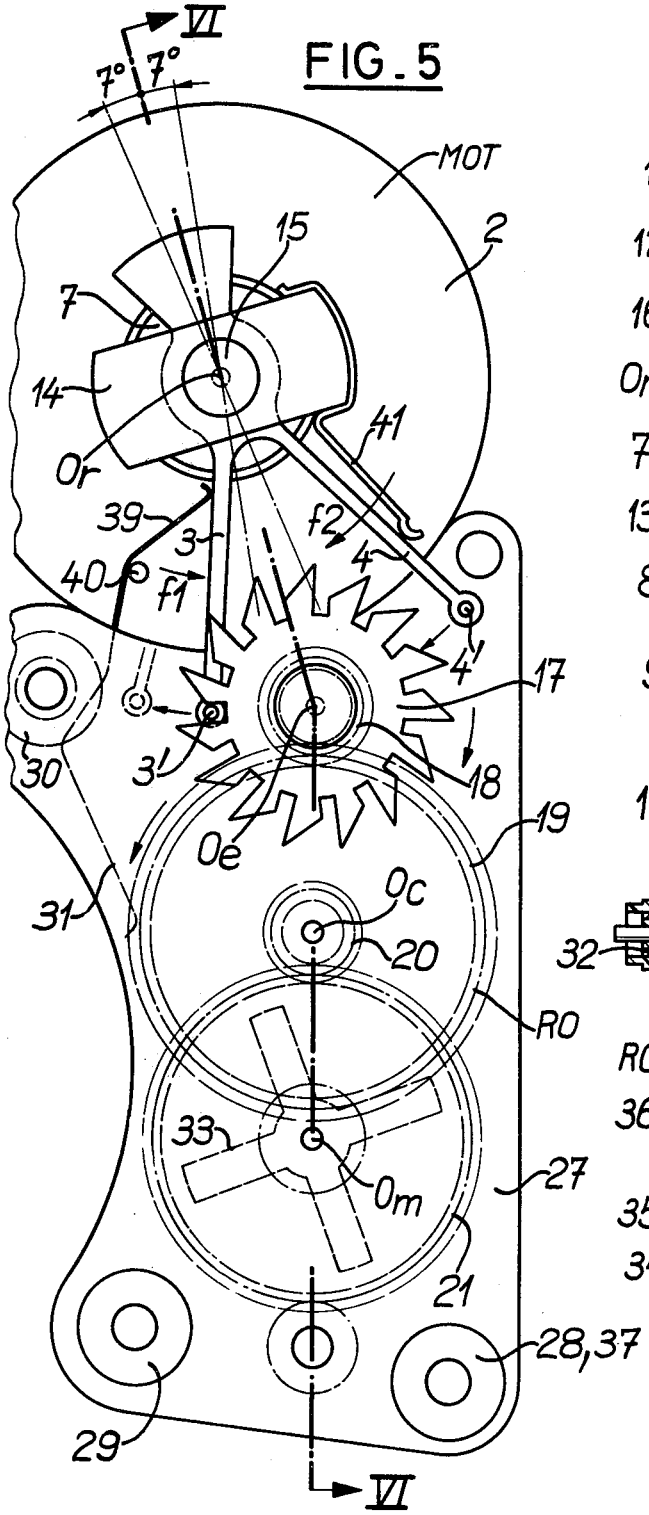
FIG. 5 is a schematic plan view of the motor and gear train of FIG. 1.

FIGS. 5 and 6 show the transmission mechanism or gear train RO driving three concentric pipes/shafts carrying the hands. Each second, the pallel arms 3, 4 of motor MOT turn a very light toothed wheel 17 integral with a pinion 18. This pinion meshes with wheel 19 driving shaft $O_c$ of a direct-drive seconds hands at a speed of 1 r.p.m, by jumps of one second. Wheel 19 is integral with a pinion 20 meshing with a setting wheel 21 carried by shaft $O_m$. This shaft has a pinion 22 meshing with wheel 23 which drives the minutes hand at 1 revolution per hour. The hours hand is driven in the usual way be gears providing a driving ratio of 1:12 from the wheel 23.

To reduce the manufacturing and assembly costs of the gear train as far as possible, the arrangement avoids use of a thick bottom plate machined with stepped bores and having bridges fixed by screws and pins. The gear train has been simplified as far as possible, taking into account the fact that the forces to be transmitted from the magneto-electric motor are far less than those provided in mechanical watches by a strong barrel spring.

The gear train, shown principally by the cross-sectional view of FIG. 6, forms a removable unit independent of base plate 1 of the watch movement. All of the wheels are held in a cage formed by two small plates 26, 27 secured together by tubular joining parts 28, 29, 30. Plates 26 and 27 are cut from a thin sheet of brass, to avoid an important loss of metal. All of the bores are cut out, and are at constant locations. The joining parts such as 28 have circular shoulders, and are simply tightly force fitted in the corresponding holes of plates 26, 27. The wheels can readily be placed by known automatic equipment, but there is a simplification, as assembly by screws and complex machining operations are eliminated.

The driven wheel 17, with a diameter of about 5 mm, has only 15 teeth shaped as shown in FIG. 5, this drawing being to an enlarged scale of 10:1, the pallel arms 3, 4 carrying pallel pins 3′, 4′ being shown in a position during an interval between the driving pulses. Because of the large pitch of the teeth of wheel 17 and the paticular form of the pallet of the pallet arms and pallets, manufacture to the usual close tolerances required in known horological mechanism is no longer necessary. Also, costly operations of cutting and polishing the teeth are avoided. The wheel 17 integral with its pinion 18 and shaft $O_r$ is easily obtained in a single operation by injection molding a thermoplastic material, for example the resin known under the Trade Mark Delrin. Use of this material enables reduction of the coefficient of friction of the steel pallet pins (for example diameter 0.2 mm) sliding on the very inclined back faces of the teeth of wheel 17. Lubricating oil, liable to alteration and a cause of trouble in movements with conventional escapement mechanisms, is hence not required.

The pallet or driven wheel 17 is integral with a 15-tooth pinion 18 driving a 60 tooth wheel 19. The high number of teeth of the driving pinion enables use of toothing with a circular development and allows engagement with a greater play than was previously employed. Despite this play, the seconds hand stops in 60 well-defined discrete positions corresponding to graduations on the dial, a jumper spring 31 which bears lightly against the toothing of wheel 19 being provided for this purpose.

The shaft $O_m$ of the direct-drive seconds hand as well as the shaft $O_m$ of the setting wheel are formed by simple cylindrical rods produced by drawing and sectioning. The end of shaft $O_c$ adjacent the watch dial is guided in a bearing lodged in a thin tube 32 of stainless steel; this tube is force fitted in the plate 27 of the gear train frame. To reinforce this fitting, the plate 27 may be stamped to provide a sleeve about the opening, as shown. About the stainless steel tube 32, concentric pipes carrying the minutes and hours hands are rotatably mounted with ample play.

The setting wheel shaft $O_m$ is lightly frictionally driven by means of a thin cruciform piece 33 having flexible arms which apply against wheel 21. This liason, able to slip, enables the gear train to be provided with an exterior manual control time-setting button of known type, on the bottom or at the side of the watch.

On an end of shaft $O_m$ freely turns setting wheel 34 with its pinion 35 which drives wheel 36 integral with the hours-hand pipe. The wheels of the gear train are advantageously made by molding a self-lubricating plastic material (this material is also used for the pallet wheel 17 as well as wheel 21 provided with a bearing turning in plate 27, as indicated in the cross-section of FIG. 6).

The frame of gear train RO is fixed on the base plate 1 of the movement by means of pillars such as 37 extended by rods fairly tightly fitted in axial holes of parts 28, 29 and 30. The sub-assembly or unit RO is held in place by clips 38, and can easily by dismantled.

The arrangements illustrated in FIGS. 5, 12 and 13 enable step-by-step driven of the gear train with a very low consumption of electrical energy. After each electro-magnetic pulse, the pallet arms 3, 4, provided with a counter-weight, occupy the position shown in FIG. 5; the wheel 17 cannot turn even if the watch is submitted to important substantial shocks or submitted to any strong acceleration. Biasing of the pallet arms towards a rest or waiting position is provided by a very flexible blade spring 39 which exerts a slight pressure in the direction of arrow $f$ 1. This biasing effect involves a very small force, because of the properties of the motor MOT described above with reference to FIGS. 2 to 4. However, it is necessary, upon manufacture of the motor, to select the setting of the pallet arms in relation to the tetrapolar magnet 7 so that in the waiting position of FIG. 5, each pole of the magnet is located facing the small gap between two adjacent arcuate pole-pieces of the stator (see FIG. 3). When this condition is satisfied, the unit formed by the cylindrical magnet 7 and pallet arms 3, 4 remains in neutral equilibrium during an angular displacement of about twenty degrees, the circuit of winding 8 being non-energized. In other words, there is no magnetic driving torque in the absence of current. It can be shown that this results from the fact that the total permeance of the air-gaps energized solely by the magnet 7 remains constant during the envisaged small angular displacement.

The electromagnetic driving action is produced in the direction of arrow $f$ 2 (opposite $f$ 1) when a short current pulse $i_m$ flows in winding 8 in the appropriate direction. In this case, each mobile pole such as N is simultaneously attracted by the arcuate pole piece of the stator receiving a "south" polarization, and repelled by the "north" arcuate pole piece. The same phenomenom is produced for the four peripheral poles of magnet 7, thereby producing a very good efficient use of the magnetomotive force produced by the ampere windings $ni_m$, where $n$ is the number of turns of winding 8. In can be seen at all of the electromgnetic torques exerted on the four poles of mobile magnet 7 concord and combine to turn the pallet arms in the direction $f_2$. As indicated in FIG. 12, the maximum path permitted by the depth of toothing 17 is about 2 $\hat{A} \leqslant$ 15°. In these conditions, the magnetic energy of tetrapolar magnet 7 is used to full advantage by the rotor. Moreover, as the purely magnetic torque is cancelled immediately when the energizing current is interrupted, it is possible to provide a very reliable return of the pallet yoke to the initial position by means of the very weak spring 39. Preferably, flexion of the spring blade 39 is limited by a stop 40 which acts so that the initial part of the driving strokes is not obstructed by an opposite mechanical force. It is also advantageous to absorb the end of movement of the pallet yoke in direction $f$ 1 by an elastic stop 41 placed as shown. This stop prevents a noisy impact of the pallet pin 3' against the wheel 17 after it has slid along the inclined face of the tooth. FIG. 12 shows that wheel 17 turns through an angle of 12° during the stroke of pallet yoke in direction $f_2$. Upon return of the pallet yoke in direction $f_1$, wheel 17 turns by a further 12°. Short unidirectionnal current pulses $i_m$ in winding 8 at intervals of 1 sec. drive the shaft $O_r$ of the seconds hand by successive jumps of 6°.

The graph of FIG. 13 illustrates the operation of motor MOT when, under the influence of a slight current pulse $i_s$, the winding circuit is closed during a short time $\Delta$ T and receives a constant voltage U from cell G. FIGS. 16 and 17 show that winding 8 is shunted by a diode Di to avoid an abrupt interruption of the operative current $i_m$ which is set up during the time T = 1 $s$ in winding 8, which has a resistance R and a relatively great self-inductance L.

At time O, the current from pulse generator EL-OSC flows in the winding and increase exponentially, as indicated in the graph by $i_m = f(t)$. The rate of increase of the current is slowed by the inductance L of the circuit. Magnet 7 turns rapidly in direction $f_2$, driving the pallet yoke, and at time $t_1$ the voltage U is cut off, the current having reached its maximum value $I_m \ll$ U/R. Diode Di conducts and prolongs flow of a rapidly decreasing current. This current comes from the electro-kinetic energy ½ $LI^2$ accumulated in the inductance L during setting up of the current from the cell. The extra current due to inductance L usefully prolongs the electromagnetic action exerted on the rotor, and contributes to the production of useful driving work. At instant $t_2$, the current $i_m$ has dropped sufficiently to allow return of the pallet yoke in direction $f_1$ up to the rest position indicated in full lines in FIG. 12. This return movement takes place under the action of spring blade 39 at a moderate speed as indicated by the graph showing the angle $\hat{a}$ of the pallet yoke as a function of time $t$.

It is observed that the start of the stroke in direction $f_2$ is facilitated by the elastic stop 41, which restitutes or delivers energy to the pallet arm 4. It can be appreciated that by judiciously selecting the mechanical and electrical parameters affecting operation, the quantity of electricity supplied by the cell to produce each driving stroke can be reduced. It has been possible to reduce the mean output of the cell by adopting the following values:

- time $\Delta$ T of the cell current : less than 15 milliseconds;
- maximum value of the current $I_m$, less than 2 milliamperes;
- period T of the driving strokes : 1 second;
- angular displacement of the rotor and pallet yoke - $2\hat{A}$ = approx 13°.

Without departing from the scope of the invention, various modifications can be made to the magnetoelectric motor MOT. For example, a hexapolar arrangement can be formed as shown in FIGS. 7 to 10. The modified stator comprises a casing of very soft iron comprising a cup 42 engaging with a tight fit on another cup 43 which carries one of the bearings 44 of shaft $O_r$ of rotor ROT, FIG. 8. The case thus formed contains two internal polar crowns formed of parts 45 and 45'. One of these parts 45 or 45' is shown in perspective on FIG. 10. It is formed of a flat plate or washer carrying three stamped internal pole-forming flanges 46, 47 and 48. These flanges have the form of portions of tubes disposed regularly (at 120°) about the rotor. Each flange has an angular extent of about 50°, and the poles of the rotor pass at a slight distance from the flanges. Parts 45, 45' are cemented or soldered onto the bottoms of cups 42 and 43 respectively. The flanges are made of a metal with very high magnetic permeability and low coercivity, for example an iron-nickel alloy available under the name "Anhyster" which is carefully tempered in a non-oxidising atmosphere. When the cups are assembled, pairs of the flanges face one another, part 45 being set at 60° to part 45' to imbricate the six arcuate pole-forming flanges of the stator. The toric winding 8 surrounds the pole-forming flanges of the stator.

The bottom of cup 42 has an opening of greater diameter than the rotor; it is extended by a projection with open sides in the form of a bridge 49 carrying a second bearing 50 guiding the central shaft $O_r$ of the rotor. This arrangement enables the use of a shaft $O_r$ on which the driving pallet yoke is non-removably fixed, the arms 3, 4 of this yoke passing between the cup 42 and bridge 49, see views (a) and (b) of FIG. 7.

The rotor could be formed of a multipolar magnetized ring of isotropic barium ferrite, the magnetization being indicated by the arrows in view (c) of FIG. 7. However, better results are obtained with a composite rotor formed of a bipolar central core 51 of highly coercive material, and two flanges 52 and 53 in soft steel respectively with a "north" and "south" magnetization. These flanges are obtained at low cost by cutting washers with radial arms and bending the arms as shown in the perspective view of FIG. 9, the gap between the consecutive arcuate poles being $\hat{\beta} \leq 10°$. The axial length $l$ of the bent-over pole-forming flanges is less than half the thickness of cylinder 51; this attenuates magnetic losses between the adjacent arcuate North and South poles.

The rotor shaft can be formed of two coaxial pieces carrying the washers and flanes 52, 53, these pieces being cemented on the opposite circular faces of a solid magnet 51, as shown in view (b) of FIG. 8. Magnet 51 may be of anisotropic barium ferrite strongly polarized parallel to the rotor axis, as indicated by the arrows.

For a motor MOT' fitted in a small quality watch, the barium ferrite could be replaced by the new alloy based on cobalt and samarium (or cerium) which has an energy production BH max greater than $10^7$ Gs. Oe. This hypercoercive material enables construction of a miniature motor with a high power/volume ratio and low consumption, having the following dimensions:

- overall rotor diameter : about 3 mm;
- outer diameter of the motor MOT : 6 mm or less;
- total thickness, including bridge 49 : less than 4 mm.

The parts 42, 43 of the stator may be made from a sheet of very soft iron which is cut, stamped and then tempered. They could also be made by molding a powder of soft iron agglomerated by a plastic material binder such as bakelite.

FIG. 11 shows a watch movement obtained by substantially reducing the volume of the model of FIG. 1 permitted by the small diameter of motor MOT' of FIG. 7. The gear train RO of FIG. 6 is retained and the four parts of the movement (MOT', RO', EL-OSC and G) are once more juxtaposed without overlap, but on a base plate 1' of barrel shape whose dimensions are $L_1 \leq 24$mm and $L_2 \leq 20$ mm. In this case, a miniature cell ($\phi$ approx 8 mm) of a type available in commerce is used. The life of such a cell is nevertheless over a year, in view of the very low consumption of the hexapolar motor of FIGS. 7 to 10.

The very compact grouping of the electromechanical parts of the watch in question offers the following additional advantage: the protective casing 5' of the energy source can be generally figure eight shaped (see FIG. 11) to lodge two miniature cells G and G', the second cell G' forming an immediately-available replacement cell with, only cell G supplying power to the watch. The second cell G' could also supply an acessory function, for example an alarm actuated by a known device, or supply a miniature flashing electric lamp of known type, which may, for example, illuminate the watch dial.

In the casings 6 (FIG. 1) or 6' (FIG. 11) which form perfect magnetic and electric screens, it is possible to place various types of generators providing control current pulses the characteristics and effects of which have been defined above with reference to FIG. 13 - see curve $i_m = f(t)$ and indications of the selected values of period T and short time $\Delta$ T of the driving pulses. In particular, miniature components already mass produced by the electronics industry can be used. These components include time-base oscillators formed of piezoelectric crystals (bars of quarts, or small tuning forks) and integrated circuits maintaining the oscillator, dividing the frequency and shaping brief spaced current pulses $i_m$.

To enable the production of battery-driven watches at a cost competitive with Roskopf-type mechanical watches, it is essential to simplify the generator of pulses $i_m$ to the extreme. Two arrangements within the purview of the present invention are:

1. a small tuning fork formed basically of a vibrating blade;
2. an electric oscillator of the R-C time constant type, directly supplying brief, very spaced pulses.

The first of these arangements is shown in FIGS. 14 to 16. A diapason or tuning fork providing a periodic signal $i_s$ according to graph (a) of FIG. 13 is composed to two thin blades $D_1$ and $D_2$ of a strip of Elinvar steel of constant section. This strip is similar to those of the mainsprings of mechanical watches, but of greater section. The two blades are folded over at one end, as shown in FIG. 15; these folded over ends are brought together and soldered or welded onto a support pin 56.

The vibrating blades $D_1$,$D_2$ are parallel at rest and at their free ends are soldered respective L-section pieces 54, 55 cut from a section bar of soft steel. Two very coercive flat magnets in the shape of elongated parallepipeds are cemented on pieces 54, 55, and are separated by a small distance, as shown in FIGS. 14 and 15. The internal lines of force of the magnets (see arrows in the drawings) are parallel and perpendicular to the base plate 1 on which support 56 is mounted. Blades $D_1$, $D_2$ vibrate in a plane parallel to plate 1.

The faces of pieces 54, 55 in a plane parallel to base plate 1 are magnetized (south poles). On the other side of the magnets, the lines of force leave the north pole in a direction normal to plate 1. Near the rectangular North-pole faces of magnets 57 and 58 is fixed a flat rectangular winding Bg whose long edges are parallel to the longitudinal axis of the fork. When arms $D_1$ and $D_2$ vibrate, oscillation of the magnets produces a sinusoidal e.m.f. Moreover, when an alternating or pulsed current flows in the winding, Laplace forces act on the ends of the blades $D_1$, $D_2$ and tend to bring them together or move them apart.

As known, a very low periodic current can be used to maintain oscillations of low amplitude with a minimal damping. The frequency of these of these oscillations depends solely on the elasticity of the flexible blades and the moment of inertia of the masses subjected to sinusoidal movement. Experience shows that the natural frequency of the vibrations is very well defined and remains independent of the maintenance forces. It is thus possible to stabilize an electric oscillator as is well known in the art.

One of the features of the invention is to employ these techniques to supply the motor MOT or MOT' of FIGS. 2 an 5 with current pulses spaced by 1 sec. In this respect, the improvements embodied in the described examples of oscillator shown in FIGS. 14 and 15 concern specifically its low cost of manufacture, since the aims of the invention would not be achieved if regulation of drive of the gear train involved a delicate and expensive regulator.

A useful additional improvement enables manufacture of the vibrating fork $D_1$– $D_2$ without great precision. In consists of adding to the fork a magnetic device which enables the manufacturer and user of the watch to easily adjust the natural frequency of the controlling vibrations. The device in question acts in an analogous manner to an index or regulator for correcting slow or fast running of mechanical watches; it is formed of a small round bipolar magnet A' located in the plane of symmmetry of the fork, below and slightly spaced from the magnetized pieces 54 and 55. This magnet A', hereinafter called the regulating magnet, is mounted on a transverse shaft 57. The orientation of the line of poles N', S' can easily be set by means of a pinion *rt* keyed on shaft 57 and engaging with a worm screw *Vr* on a shat carrying a manually engageable control button (not shown) protruding externally from casing 6.

FIG. 16 shows an example of an electronic feedback circuit maintaining oscillation of the fork. This circuit comprises a first transistor $TR_1$ switching off or on the current supplying the energization winding B, and an auxiliary transistor *tr* supplying the base of $TR_1$ at the appropriate moment. The feedback for maintaining the oscillations given by resistor Rr connected between the collector of $TR_1$ and the base of *tr*. Regulation is carried out by acting on the polarisation of *tr* by means of resistor R*p*, and on the collector-emitter current of *tr*, by means of resistor *r*. Resistor *re*, connected in series in the circuit connecting winding B to frequency divider DF, limits the strength of current in DF.

At the output of divider DF, preferably having a division ratio equal to the natural frequency $2^9$ of the diapason, rectangular pulses of frequency 1 Hz and of unitary cylic ratio are transformed into brief pulses by a delay circuit formed by a resistor *rs* and a capacitor C connected in cascade with transistor $TR_2$ which supplies motor MOT.

The circuit is enclosed in metal case 6 which, as mentioned, has good magnetic conduction properties and forms a perfect screen against strong magnetic and electromagnetic fields.

FIG. 17 shows, by way of example, an embodiment with a purely electronic oscillator replacing the previously described diapason. The oscillator shown is a simple and precise relaxation oscillator forming a clock pulse generator.

The time base elements are on the one hand a fixed capacitor C and on the other hand a resistor R formed by connecting a fixed resistor Rf and a variable resistor Rv, adjustable by means of a cursor movable along a graduated sector A–R.

There are three operative components. Firstly, a transistor TR2 which delivers current to the winding 8 of motor MOT. Secondly, in the time base itself which acts on the base of TR 2 via resistor *rs*, there are provided two transistors *tr* and TR, one of NPN type and the other on PNP type. Thirdly, a discharge resistor *rd* connects the collector of TR to the negative pole of cell G.

As capacitor C charges via resistor R, the increasing voltage is applied to the base of transistor *tr*. When this voltage reaches a given threshold value, transistor *tr* begins to conduct, which causes an accentuated conduction of TR and an abrupt discharge of capacitor C. A further charging of capacitor C begins immediately, followed by an abrupt discharge, and the cycle is repeated regularly. The current pulses produced have a duration of $\Delta$ T, far less than the period T of the oscillations which is assumed here to be 1 second.

FIG. 18 shows the variation of the current $i_m$ flowing in the winding as a function of time. The curve given corresponds to a winding of low inductance. The maximum current will be equal to $U/R_b$ where $R_b$ would be the resistance of the winding if the mobile part of the winding did not move, i.e. if no counter e.m.f. opposed the flow of current.

The circuit shown by way of example is interesting in that the RC circuit acts on an amplifying chain composed of two transistors, hence with a relatively high gain. It is thus possible to obtain periods T with inexpensive components of low bulk. Using microcapacitors of "tantale" and subminiature resistors, easy to house in a watch case, it is possible by selecting the components to obtain values of the period from a fraction of a second to a minute. The reduction of the number of components reduces the cost and facilitates temperature compensation obtained by using non-linear resistor Rf of which a part can conveniently be influenced by the temperature.

For various applications, the precise is acceptable, the relative error being less than 1% with good quality components. The time measuring precision is even further enhanced when the clock pulse generator is carefully shielded from radioelectric interference, i.e. protected from external electromagnetic fields by the electric screen 6 shown in FIG. 17.

The invention includes the combination consisting of replacing the single transistor $TR_2$ by a transistor pair allowing bi-directional pulses. The interface in question is conventional, and has therefore not been shown. It employs two NPN and PNP transistors connected in series between the positive and negative poles, the winding 8 being connected between the common point of the emitters of the two transistors and the terminal of a capacitor of relatively high capacitance whose other terminal is connected to one of the two poles, the two bases being interconnected and connected to the resistor *rs*.

What is claimed is:

1. An electromechanical watch movement comprising:

a. a stepping motor comprised of a generally closed hollow case of high magnetic permeability material for magnetically shielding the motor, a multipolar permanently magnetized rotor having at least one pair and less than four pairs of equidistantly spaced magnetic poles, mounting means mounting said rotor within said case for rotation about an axis of rotation, stator means defining a plurality of stator pole pieces concentrically disposed equidistantly spaced about the rotor axis of rotation and equal in number to the number of rotor poles, said stator means defining stator pole pieces having arcuate surfaces facing and lying in a common plane with said rotor poles and spaced to define between said stator pole pieces air-gaps having a totalpermeance which remains substantially constant upon rotation of said rotor, and a coil wound in the common plane of said rotor and said stators and would about the same within said case for receiving electrical pulses in use to magnetically polarize said stator pole pieces and effect rotation of said rotor;

b. a driving pallet connected to said mounting means in order to rotate with said rotor;

c. a time display gear train cooperative with said driving pallet and driven thereby upon rotation of the driving pallet by the rotation of said rotor;

d. a pulse generator for supplying periodic constant polarity electrical pulses to said motor coil to periodically energize the same and polarize said stators to angularly displace said rotor by an angle less than 15° from an equilibrium first position to a second position;

e. means for mechanically biasing said rotor from the second position to the equilibrium first position; and f. an elastic stop coactive with said driving pallet for absorbing energy as said rotor returns to its equilibrium first position.

2. A watch movement according to claim 1 wherein said rotor is on the order of 3 millimeters in diameter.

3. A watch movement according to claim 1, wherein said pulse generator includes a master oscillator having an output frequency of 512 Hertz.

4. A watch movement according to claim 1, in which the rotor comprises a central permanent magnet of high coercivity magnetized parallel to said axis of the rotor, and two circular plates of ductile steel each having a plurlaity of peripheral spaced-apart folded-over flanges, said plates enclosing said central magnet with said flanes imbricated in one another to form circumferentially spaced apart arcuate pole pieces, and the stator means comprising two parts of magnetizable material disposed on opposite faces of said motor winding, said parts having disposed within the inner periphery of said winding circumferentially spaced-apart sections of a tube imbricated in one another to form said stator pole pieces.

5. A watch movement according to claim 4, in which said casing of the stator is formed of two soft-iron cups removably fitted together with a friction fit, said cups forming said parts carrying said tube section, said tube sections being in a metal of very high magnetic permeability and low coercitity.

6. A watch movement according to claim 5, in which said rotor is carried by a shaft having first and second ends, said cups each carrying a central bearing receiving a respective end of the shaft, one of the cups having means defining a projecting central bridge carrying the bearing and a pair of opposed lateral openings under the bridge, and comprising a yoke secured to said shaft adjacent said bridge, said yoke including a pair of arms carrying said driving pallets protruding through one of said lateral openings and a counterbalancing part protruding through the other of said lateral openings.

7. A watch movement according to claim 6, in which said yoke is cut from a thin plate and carries at extremities of said arms pallet-forming cylindrical pins, said gear train including a driven wheel cooperating with said pallet pins, said driven wheel being molded in a light plastic material and including peripheral assymetric saw-tooth each including a radical face and a steeply inclined face extending by a radial face to define grooves separating the teeth, said grooves being slightly wider than the diameter of said pallet pins, the length of said inclined faces being at least twice the width of said grooves.

8. A watch movement according to claim 1, comprising a base plate and removably mounted without overlap on said base plate:

a. a hermetically closed case for containing a power source for supplying said pulse generator and said winding;

b. a cage carrying said gear-train; and c. a casing of soft iron coated with a very good electrically conducting material, said casing forming a magnetic and electric shield enclosing the pulse generator.

* * * * *